US005267899A

United States Patent [19]

Longtin

[11] Patent Number: 5,267,899

[45] Date of Patent: Dec. 7, 1993

[54] DEFECTIVE EQUIPMENT WINDOW STICKERS

[75] Inventor: Andre G. Longtin, Weare, N.H.

[73] Assignee: Moore Business Forms, Inc., Grand Island, N.Y.

[21] Appl. No.: 824,407

[22] Filed: Jan. 23, 1992

[51] Int. Cl.[5] ..... B41L 1/24

[52] U.S. Cl. ..... 462/7; 281/2; 283/81; 462/8

[58] Field of Search ..... 462/7, 5; 283/81, 79, 283/80

[56] References Cited

U.S. PATENT DOCUMENTS

| | | | |
|---|---|---|---|
| 3,123,384 | 3/1964 | Baker | 282/1 |
| 4,121,856 | 10/1978 | Brunette | 283/81 X |
| 4,159,129 | 6/1979 | Lockhart | 282/27 |
| 4,159,586 | 7/1979 | Blum | 283/81 X |
| 4,191,405 | 3/1980 | Johnstun | 282/28 |
| 4,277,089 | 7/1981 | Lockhart | 282/27 R |
| 4,363,685 | 12/1982 | White | 156/212 |
| 4,614,361 | 9/1986 | Foster | 282/8 R |
| 4,695,077 | 9/1987 | Pretre | 283/81 |
| 4,715,620 | 12/1987 | Thompson | 282/9 R |
| 4,720,479 | 1/1988 | Craig et al. | 503/200 |
| 4,747,619 | 5/1988 | Sager | 282/9 R |
| 4,863,195 | 9/1989 | Capozzola | 283/75 |
| 4.940,690 | 7/1990 | Skees | 503/206 |
| 4,951,970 | 8/1990 | Burt | 283/67 |
| 4,955,640 | 9/1990 | Anderson | 283/81 X |
| 5,030,491 | 7/1991 | Shoesmith | 281/2 X |
| 5,050,909 | 9/1991 | Mertens et al. | 283/81 |

FOREIGN PATENT DOCUMENTS

| | | |
|---|---|---|
| 2566564 | 6/1984 | France . |
| WO88/03480 | 5/1988 | PCT Int'l Appl. . |
| 2244674A | 12/1991 | United Kingdom . |

*Primary Examiner*—Paul A. Bell
*Attorney, Agent, or Firm*—Nixon & Vanderhye

[57] ABSTRACT

A specially constructed label is useful for application of a first face of the label to the inside face of a transparent pane so that it is visible from the outside face, and which label may have indicia applied to its first face. The label first face has self-imaging material, and it is covered by a transparent release liner, with laminating adhesive between the release liner and the label first face. Writing applied to the release liner will be transferred to the first face. The label is preferably part of a business form having a paper sheet attached by adhesive at an overlap area between the paper sheet and the label. Perforations allow ready detachment of the label from the paper sheet. The business forms are constructed by passing a web of plain paper and NCR paper to an adhesive application station, to printing stations for the application of printing to the first faces, to a station where the release liner and adhesive are brought into contact with the NCR paper, and then to a cutting station where the web is cut into individual forms, perpendicular to the direction of movement of the web during construction.

13 Claims, 2 Drawing Sheets

DEFECTIVE EQUIPMENT WINDOW STICKERS

BACKGROUND AND SUMMARY OF THE INVENTION

There are many situations in which it is desirable to be able to apply a sticker on the inside of a transparent pane to protect the sticker from the elements and/or for easy removal, yet allow it to be read from outside of the area enclosed by the pane. One example of such a use is in the tagging of motor vehicles which have a safety or other violation.

According to the present invention, a label is provided that is particularly useful for disposition on the inside of a transparent pane so that it is visible from the outside, which label is constructed in such a manner that handwritten indicia can be applied to the label prior to the label being brought into contact with the pane. The invention also contemplates a business form which includes the label as one part thereof, as well as a paper "stub" part that may be maintained in a book, fastened with other stubs at one edge thereof, on which information corresponding to that provided on the label may be handwritten. The business form and label according to the present invention are constructed in a simple yet effective manner utilizing readily available component parts and standard equipment.

According to one aspect of the present invention a label is provided which comprises the following elements: A body sheet having first and second faces. Indicia disposed on the first face. A transparent release sheet. Adhesive operatively connecting the transparent release sheet to the body sheet first face, so that the release sheet may be removed from the body sheet and adhesive, and the adhesive will then attach the first face to a substrate. And, image transfer means acting between the release sheet and the body sheet for transferring indicia formed on the release sheet onto the body sheet first face. The image transfer means preferably comprises a self-contained (self-imaging) coating disposed on the body sheet first face, between the first face and the adhesive which is a laminating adhesive. The body sheet is typically paper, and the indicia comprises words and lines indicating where printing (handwritten information) should be placed.

The invention also comprises a business form. The business form includes the following components: A first sheet of paper, having first and second faces, with indicia disposed on the first face, and a first straight edge. A second sheet of paper operatively connected to the first sheet of paper adjacent the first edge thereof, the second sheet having first and second faces generally coplanar with the first sheet first and second faces. A line of weakness formed between the first and second sheets so that they may be separated from each other. And, a first adhesive operatively disposed on the first face and capable of attaching the first sheet first face to a substrate.

Typically the second sheet of the business form has a first edge adjacent the first sheet first edge, and a second edge, opposite the first edge. Means are provided, such as staples, for connecting together a plurality of identical forms at the second edges of the second sheets, to form a book. The first and second sheets may be operatively connected together by a portion of one of the sheets, adjacent the first edge thereof, overlapping the other sheet, and connected to it by a second adhesive. The first sheet of the business form preferably comprises the label described above, including the transparent release sheet and image transfer means.

According to another aspect of the present invention, a method of constructing a business form using first and second sheets of paper, each having a first straight edge, and each having first and second faces, is provided. The method comprises the steps of substantially sequentially: (a) Feeding the first and second sheets together so that the first edges thereof slightly overlap, defining an area of overlap. (b) Applying a first adhesive between the sheets at the area of overlap thereof, to form a common web. (c) Printing permanent indicia on the first faces of the sheets as they are travelling in a first direction, generally parallel to the first straight edges thereof. (d) Applying a web of release liner having laminating adhesive thereon into contact with the first face of the first sheet. And, (e) cutting the common web in a direction transverse to the first edges of the sheets, to provide individual business forms. There preferably is also the further step of forming lines of weakness in the second sheet, adjacent the area of overlap, and the first sheet is preferably paper having a self-imaging material on the first face, step (d) being practiced to bring the laminated adhesive on the release liner web into contact with the self-imaging material. Step (b) is practiced by applying a stream of cold flow adhesive and a stream of hot melt adhesive to the area of overlap, preferably the streams of adhesive being applied to the first face of the second sheet, just prior to the practice of step (a).

According to another aspect of the present invention, a method of forming a business form, using a paper web having a first face and a second face, is provided, comprising the steps of substantially sequentially: (a) Moving the web in a first direction. (b) As the paper web is moving in the first direction, printing indicia on the first face thereof. (c) Applying a web of transparent release liner having a laminating adhesive onto a first portion, but not a second portion, of the first face of the paper web as it is moving in the first direction so that the adhesive comes into operative contact with the first face of the first portion, the release liner web travelling in the first direction as it is applied. And, (d) cutting the common web in a direction transverse to the first direction, to provide individual business forms. There also is preferably the further step of forming a line of weakness (perforation) in the web second portion adjacent the first portion, and forming a plurality of forms into a book, the forms attached together at the second portion of each form.

It is the primary object of the present invention to provide a simple yet effective label, business form, and method of constructing a business form, so as to facilitate handwriting on a label which is then applied to the inside surface of a transparent pane, such as a motor vehicle windshield. This and other objects of the invention will become clear from an inspection of the detailed description of the invention, and from the appended claims.

DETAILED DESCRIPTION OF THE DRAWINGS

Figure 1:
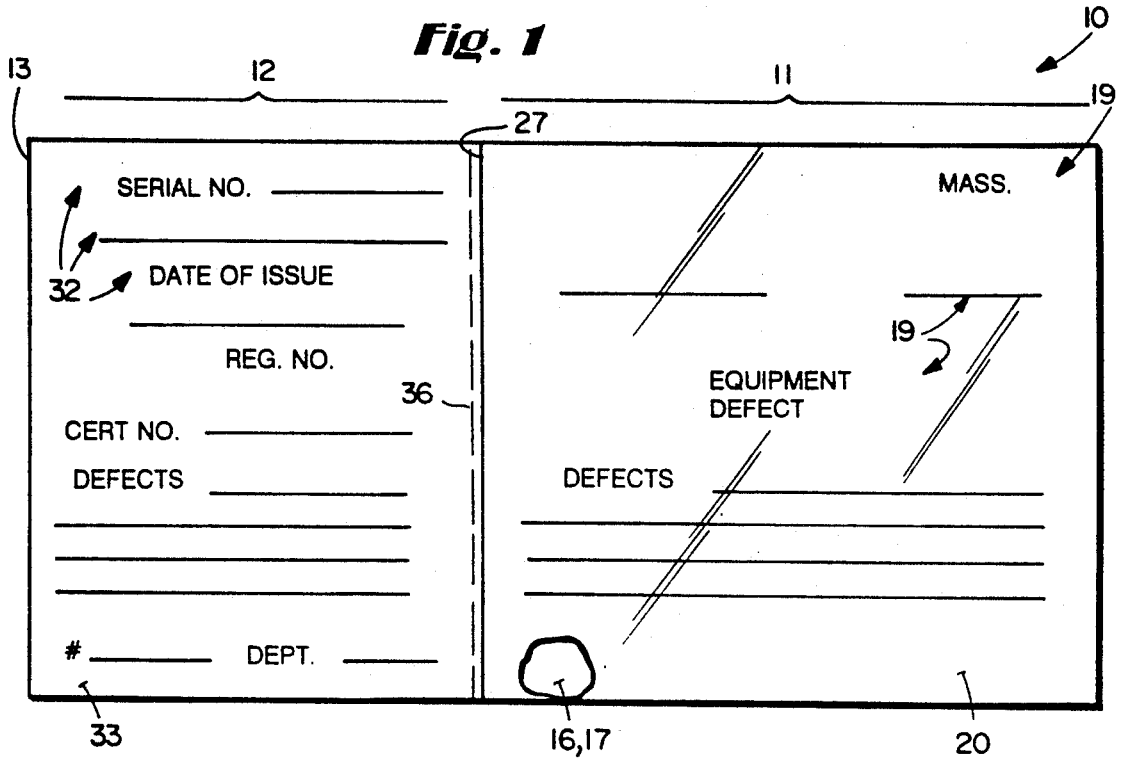
FIG. 1 is a top plan view of an exemplary business form according to the invention, showing an exemplary label according to the present invention on a right hand portion thereof.
Figure 2:
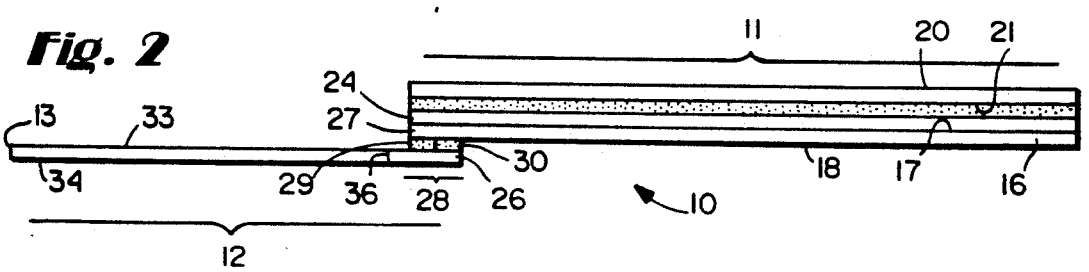
FIG. 2 is a side schematic view, with all of the components greatly enlarged for clarity of illustration, of the business form of FIG. 1.
Figure 3:
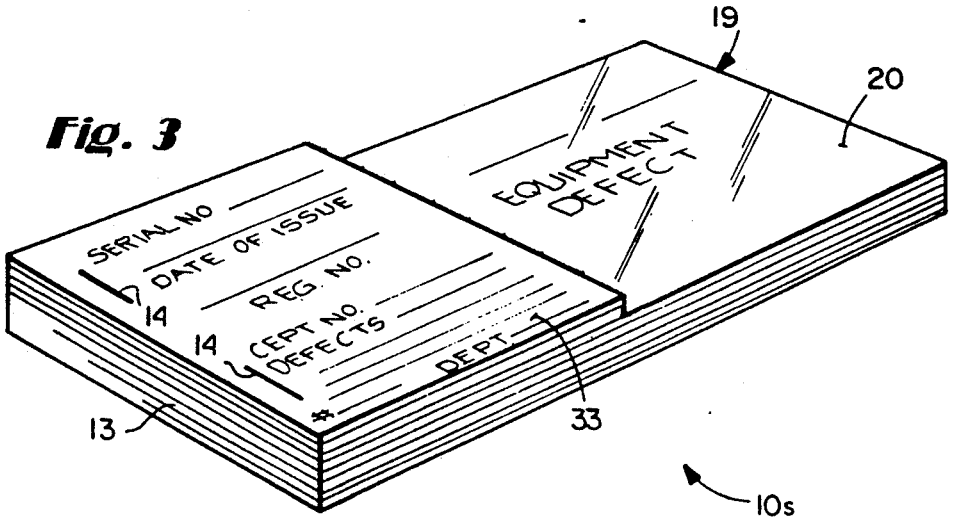
FIG. 3 is a top perspective view of a book of forms of FIG. 1, some of which have had the label (right hand portion) thereof detached.

An exemplary business form according to the present invention is shown generally by reference numeral 10 in FIGS. 1 through 3. The business form includes two major components, a label portion or component 11, and a stub portion or component 12. Typically a plurality of forms 10 are formed together into a book and connected together at the leftmost edges 13 of the portions 12 by staples 14, or like fastening means, as illustrated in FIG. 3.

The label component 11 includes a first, body sheet 16, typically of paper having a first or top face 17, and a bottom or second face 18. On the top face 17 indicia is provided, illustrated generally by reference numeral 19 in FIGS. 1 and 3, and a transparent release sheet 20. Adhesive 21 (see FIG. 2) is provided between the transparent release sheet 20 bottom face and the first face 17 of the first paper sheet 16, the adhesive 21 being of the type such that the release sheet 20 may be removed from the body sheet and adhesive, with the adhesive then being capable of attaching the body sheet 16 first face 17 to a substrate, such as a transparent (e.g. glass) pane 23 (see FIG. 4), such as a motor vehicle windshield.

The label 11 also comprises image transfer means acting between the release sheet 20 and the body sheet 16 for transferring indicia handwritten or otherwise formed on the release sheet 20 top surface onto the body sheet first face 17. The image transfer means, as illustrated in FIG. 2, preferably comprises a self-contained (self-imaging) coating on the sheet 16. While the components constructing the label portion 11 may take a wide variety of forms, one particularly advantageous construction is 22# NCR self-contained sheet as the basic label product (sheet 16 and coating 24), with a 3M 9457 laminating adhesive release liner and adhesive being provided as the component 20, 21.

The stub portion 12 of the business form 10 preferably comprises a second paper sheet, such as 24# ledger paper. In addition to the edge 13, the stub portion 12 has a first straight edge 26 which overlaps a first straight edge 27 of the label portion 11 body sheet 16. An area of overlap 28 (see FIG. 2) is provided, and an adhesive is utilized to attach the portions 11, 12 together at the area of overlap 28. Adhesive for attaching the portions 11, 12 together may be provided by a first stream 29 of cold flow adhesive, and a second stream 30 of hot melt adhesive.

The stub portion 12 also includes indicia 32 printed on the top, first, face 33 thereof. Typically indicia is not printed on the bottom faces 18, 34 (see FIG. 2) of the portions 11, 12, but if desired printing, such as instructions for removal, can be provided on the bottom faces 18, 34.

In order to allow ready separation between the components 11, 12 a line of weakness 36 (see FIGS. 1 and 2), such as a perforation, is provided adjacent the first edge 27 of the sheet 16. The line of weakness 36 is actually provided in the stub portion 12.

Figure 4:
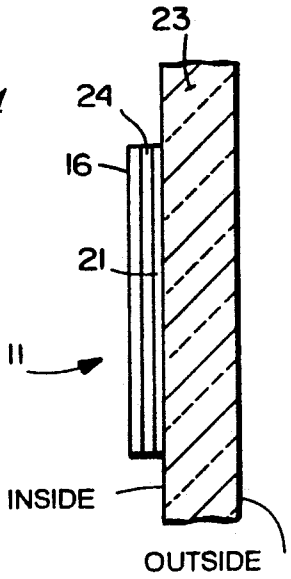
FIG. 4 is a schematic side view, partly in cross-section and partly in elevation, of a label according to the present invention applied to the inside surface of a transparent pane.

In utilizing the business form 10, for example as a defective equipment sticker to be applied to the windshield of a motor vehicle, an officer will write on the top face 33 of the stub 12, and the top face of the release liner 20. Normally lines—such as included as part of the indicia 19, 32—are provided as part of the indicia to allow the officer to enter particular requested information, such as the serial number of the vehicle, the type of defect, the date, etc. After both the stub 12 and the label 11 have been filled out, the officer detaches the portions from each other along the line of weakness (perforation) 36. The officer then removes the release liner 20 from the body sheet 16 of the label portion 11. The indicia handwritten by the officer onto the release liner 20 has been transferred to the body sheet 16 by the self-imaging means/self-contained coating 24. When the release liner 20 is removed, adhesive 21 stays in contact with the body 16 and self-contained imaging material 24 thereon. Then the sticker portion 11 is applied to the inside surface of the pane 23, as illustrated in FIG. 4 with the adhesive actually in contact with the inside surface of the window 23. Both the pre-printed and the handwritten indicia on the label 11 are visible and readable from outside of the pane 23.

Figure 5:
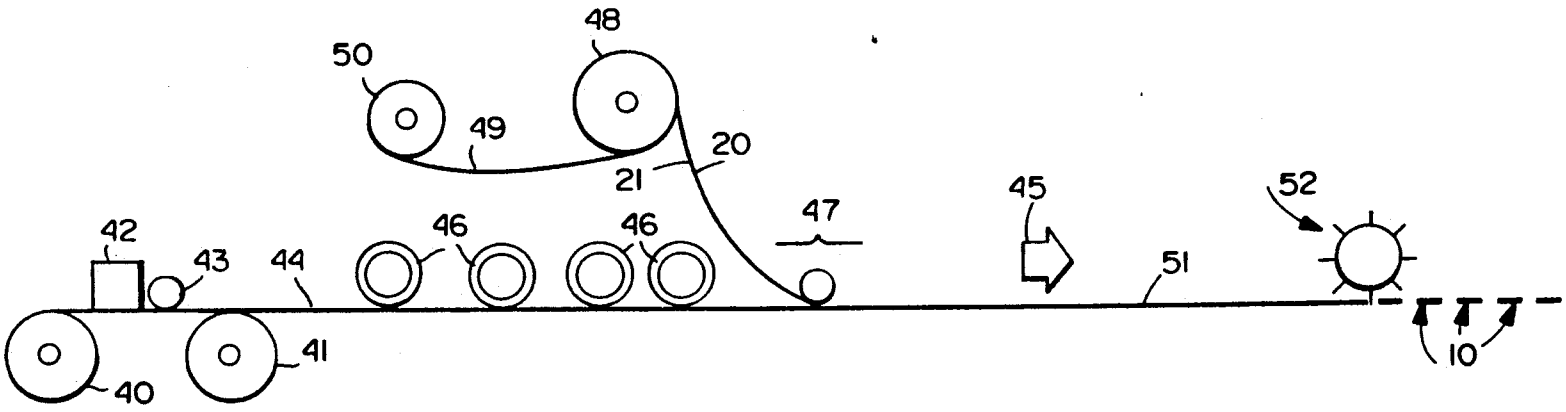
FIG. 5 is a schematic view illustrating apparatus utilizable for the practice of the method according to the present invention.

Exemplary apparatus for manufacturing the business form 10 according to the invention, and practicing the method according to the invention, is illustrated schematically in FIG. 5. Basically the apparatus comprises a 1600 Webtron press with sidestick and lamination unit. A first roll of paper web 40 preferably comprises the paper sheet that will make up the stub portion 12 of the final form 10, such as 24# ledger, 2 7/8 inches wide, provided on the left side of the Webtron press. The roll 41 of web material which comprises the base paper 16 (with self-imaging material coating 24) may comprise NCR 22# white self-contained blue 3⅜ inches wide, which is provided on the right side of the press.

A perforating apparatus 42, to form the line of weakness 36, may be provided before the webs from the rolls 40, 41 are brought into alignment with each other, and adhesive application can be provided by conventional apparatus 43, also before the webs from rolls 40, 41 are brought into alignment. For example the conventional adhesive applicator 43 could apply a cold flow adhesive stream 29 and a hot melt adhesive stream 30 to the portion of the material from roll 40 adjacent the edge 26 at the overlap area 28, which is about ⅜ inches wide. When the webs from rolls 40, 41 are then brought together, the web from the roll 41 will be on top of the adhesive 29, 30, that is the faces 33, 18 will be in face to face proximity at the area of overlap 28.

The common web of material 44, containing the webs from both the rolls 40, 41, is caused to travel in the direction 45 by any conventional means (not shown), such as drive rollers, and moves past one or more print stations 46. At the print stations 46, the indicia 19, 32 are applied to the top faces 17, 33, respectively, of the common web 44.

After the print stations 46, the common web 44 moves to a station or area 47 in which the release liner 20 and adhesive 21 are applied. This is preferably accomplished by unwinding the roll 48 of 3M 9457 laminating adhesive, which comprises adhesive between two release liners, one release liner 49 which is removed and wound up on roll 50, and the transparent release liner 20 which has the adhesive 21 thereon. The liner 20 is brought into contact with the web 44, right portion (over the face 17) so that the adhesive 21 comes into contact with the self-contained coating 24. The composite that is formed then passes to the conventional removable blade sheeter 52 which forms cut sheet singles 10 about 5 $\frac{7}{8}$ inches by 3 inches, transverse to the direction of movement 45 of the composite 51. To ensure exact size, as the 3M 9457 press it is slit so that it is 3$\frac{7}{8}$ inches wide, being slit at the same time as the NCR sheet from roll 41 to provide the exact width necessary at the front of the press. Ultimately, the individual forms 10 are placed into books, e.g. books of 50 stickers each as illustrated in FIG. 3, fastened together by staples 14 or the like adjacent the second ends 13 of the stub portions 12.

It will thus be seen that according to the present invention an advantageous label, business form, and methods of constructing business forms have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and processes.

What is claimed is:

1. A label comprising:

a body sheet having first and second faces;

indicia disposed on said first face;

a transparent release sheet;

adhesive operatively connecting said transparent release sheet to said body sheet first face, so that said release sheet may be removed from said body sheet and adhesive, and said adhesive may then be used to attach said first face to a substrate; and image transfer means acting between said release sheet and said body sheet for transferring indicia formed on said release sheet onto said body sheet first face.

2. A label as recited in claim 1 wherein said image transfer means comprises a self contained coating disposed on said body sheet first face, between said first face and said adhesive.

3. A label as recited in claim 2 wherein said body sheet is paper.

4. A label as recited in claim 3 wherein said indicia comprises words and lines indicating where printing should be placed.

5. A label as recited in claim 1 wherein said body sheet is paper.

6. A label as recited in claim 1 wherein said indicia comprises words and lines indicating where printing should be placed.

7. A business form comprising:

a first sheet of paper, having first and second faces, with indicia disposed on said first face, and a first straight edge;

a second sheet of paper operatively connected to said first sheet of paper adjacent said first edge thereof, said second sheet having first and second faces generally coplanar with said first sheet first and second faces;

a line of weakness formed between said first and second sheets so that they may be separated from each other;

a first adhesive operatively disposed on said first face of said first sheet and capable of attaching said first sheet first face to a substrate;

a transparent release sheet;

said first adhesive operatively connecting said transparent release sheet to said first sheet first face, so that said release sheet may be removed from said first sheet and adhesive, and said adhesive may then be used to attach said first face of said first sheet to a substrate; and image transfer means acting between said release sheet and said first sheet for transferring indicia formed on said release sheet onto said first sheet first face.

8. A business form as recited in claim 7 wherein said second sheet has a first edge adjacent said first sheet first edge, and a second edge, opposite said first edge; and further comprising means for connecting a plurality of identical forms together at said second edges of said second sheets.

9. A business form as recited in claim 8 further comprising:

a transparent release sheet;

said first adhesive operatively connecting said transparent release sheet to said first sheet first face, so that said release sheet may be removed from said first sheet and adhesive, and said adhesive may then be used to attach said first face of said first sheet to a substrate; and image transfer means acting between said release sheet and said first sheet for transferring indicia formed on said release sheet onto said first sheet first face.

10. A business form as recited in claim 9 wherein said image transfer means comprises a self contained coating disposed on said first sheet first face, between said first face and said first adhesive.

11. A business form as recited in claim 7 wherein said image transfer means comprises a self contained coating disposed on said first sheet first face, between said first face and said first adhesive.

12. A label as recited in claim 7 wherein said indicia comprises words and lines indicating where printing should be placed.

13. A business form as recited in claim 7 wherein said first and second sheets are operatively connected together by a portion of one of said sheets, adjacent said first edge thereof, overlapping said other sheet, and connected thereto by a second adhesive.

* * * * *